US012077976B2

(12) United States Patent
Fennessy

(10) Patent No.: US 12,077,976 B2
(45) Date of Patent: Sep. 3, 2024

(54) MONUMENT CAP DEVICE COMPRISING A CIRCULAR LID AND AN ADHERING STRUCTURE

(71) Applicant: Sheila Fennessy, Lemont, IL (US)

(72) Inventor: Sheila Fennessy, Lemont, IL (US)

( * ) Notice: Subject to any disclaimer, the term of this patent is extended or adjusted under 35 U.S.C. 154(b) by 0 days.

(21) Appl. No.: 17/834,604

(22) Filed: Jun. 7, 2022

(65) Prior Publication Data

US 2022/0298824 A1 Sep. 22, 2022

Related U.S. Application Data

(62) Division of application No. 17/122,945, filed on Dec. 15, 2020, which is a division of application No. 16/109,521, filed on Aug. 22, 2018, now Pat. No. 11,028,612.

(51) Int. Cl.
*E04H 13/00* (2006.01)

(52) U.S. Cl.
CPC ..... *E04H 13/001* (2013.01); *E04H 13/003* (2013.01)

(58) Field of Classification Search
CPC ... E04H 13/001; E04H 13/003; B65D 41/165; B65D 41/185; B65D 41/28; B65D 2543/0049; B65D 2543/00092; B65D 43/022
USPC ..... 27/1, 30; 52/103, 104; 220/800, 801, 220/287, 789; 215/320, 355, 363
See application file for complete search history.

(56) References Cited

U.S. PATENT DOCUMENTS 508,471 A * 11/1893 Hickey et al. ..... B60K 15/0406 220/301
975,926 A * 11/1910 Bazeley ..... 220/800
1,888,319 A * 11/1932 Hopkins ..... B65D 43/022 220/801
2,637,462 A * 5/1953 Becker ..... F16L 57/005 16/42 T
3,165,227 A * 1/1965 Muoio ..... B65D 43/0218 220/802
3,168,961 A * 2/1965 Yates ..... F16B 21/086 220/789
3,623,628 A 11/1971 Rericha
4,583,654 A * 4/1986 Pufpaff ..... B65D 39/04 220/DIG. 19
D359,294 S * 6/1995 Szabo ..... D15/138
D359,970 S 7/1995 Szabo
5,578,491 A * 11/1996 Kayal ..... C12M 23/08 435/288.1
5,813,529 A * 9/1998 Goserud ..... B65D 51/245 220/254.1
5,901,866 A * 5/1999 Storar ..... B65D 51/241 215/249
D414,694 S * 10/1999 Richter ..... D9/439
(Continued)

*Primary Examiner* — William L Miller
(74) *Attorney, Agent, or Firm* — DLA Piper LLP (US)

(57) ABSTRACT

Various embodiments of a monument cap device are disclosed. In one embodiment, a monument cap comprises a circular lid with a first sidewall along its circumference; a second sidewall protruding from a bottom face of the circular lid, the second sidewall having an outer diameter that is smaller than an outer diameter of the first sidewall; a plurality of legs extending from the second sidewall for engaging with an opening; and a plurality of brace members each extending between one of the plurality of legs and the bottom face.

5 Claims, 10 Drawing Sheets

(56) References Cited

U.S. PATENT DOCUMENTS

| | | | | |
|---|---|---|---|---|
| 6,463,703 | B1 * | 10/2002 | Mattis | E04H 13/003 52/103 |
| D490,767 | S * | 6/2004 | Nagasawa | D12/400 |
| 6,904,721 | B1 * | 6/2005 | Forbes | E04H 13/008 52/103 |
| 7,347,655 | B2 * | 3/2008 | Nagasawa | B62D 25/24 24/297 |
| 7,581,361 | B1 * | 9/2009 | Murkland | E04B 1/72 52/21 |
| 7,922,033 | B2 * | 4/2011 | Kearby | E02D 29/10 217/114 |
| 8,919,606 | B2 * | 12/2014 | Sato | B62D 25/24 220/802 |
| D721,029 | S * | 1/2015 | Sato | D12/400 |
| 8,978,725 | B2 * | 3/2015 | Koshiyama | B60B 21/12 301/95.104 |
| 9,481,202 | B2 * | 11/2016 | Poland | B60B 1/041 |
| 2004/0020817 | A1 * | 2/2004 | Joersz | A61G 17/0136 206/459.5 |
| 2004/0091335 | A1 * | 5/2004 | Nagasawa | B62D 25/24 411/508 |
| 2004/0262982 | A1 * | 12/2004 | Varrone | B60B 1/044 301/58 |
| 2008/0034648 | A1 * | 2/2008 | Rasmussen | E04H 13/003 47/41.1 |
| 2008/0229679 | A1 * | 9/2008 | Trail | E04H 13/003 52/103 |
| 2009/0045159 | A1 * | 2/2009 | Rosso | B65D 39/16 215/320 |
| 2010/0219190 | A1 | 9/2010 | Mineo | |

* cited by examiner

MONUMENT CAP DEVICE COMPRISING A CIRCULAR LID AND AN ADHERING STRUCTURE

PRIORITY CLAIM

This application is a divisional application of U.S. patent application Ser. No. 17/122,945, filed on Dec. 15, 2020, and titled "Monument Cap Device Comprising a Circular Lid and an Adhering Structure," which is a divisional application of U.S. patent application Ser. No. 16/109,521, filed on Aug. 22, 2018, titled, "Monument Cap Device Comprising a Circular Lid and an Adhering Structure," and issued as U.S. Pat. No. 11,028,612, which are incorporated by reference herein.

FIELD

The disclosure relates to a monument cap device that comprises a circular lid and an adhering structure for securing the device to a hole or receiving structure to protect the hole or receiving structure and to prevent lateral movement of the device.

BACKGROUND

Conventionally, it is common to have a cylindrical, underground opening for holding a flower vase next to a headstone at a graveyard or cemetery. The opening sometimes is part of a hole in the ground, and it sometimes is formed by a receiving structure made of concrete, metal, or another material. Flower vases sometimes are made from valuable metal such as copper or bronze and are prone to theft. The gaping hole that remains next to the headstone once the flower vase is removed can be unsightly, or in the case of theft, can cause visitors to the headstone to feel violated. Uncovered openings also can gather dirt and debris, leaves, weeds, and still-water which becomes a breeding ground for mosquitoes.

What is needed is a device for covering the hole in instances where a flower vase is not present. What is further needed is that the device be relatively inexpensive to construct (which has the added benefit of making it less prone to theft than a flower vase) and that it be able to be secured to holes or receiving structures of varying diameters, sizes, and/or shapes.

SUMMARY OF THE INVENTION

The present invention comprises a monument cap with optional ornamental features that can be placed over an opening when the opening is not in use for displaying flowers and that maintains the aesthetic appearance of the headstone while preventing dirt, weeds or still-water from accumulating in the opening. The bottom-facing portion of the monument cap has a sidewall with a groove and an inner sidewall with protrusions or legs that secure the monument cap firmly within the opening and prevent it from being moved laterally by wind, a lawn mower, or a passerby. The number, length, and flexibility of the protrusions or legs can be adjusted to increase stability and sturdiness, and, although not required, may be supported by braces. The monument cap can have a slot into which a coin or key may be inserted to pry the cap off from the opening if it becomes tightly-fitted due to dirt or debris.

DETAILED DESCRIPTION OF THE EMBODIMENTS

Reference will now be made in detail to the embodiments, examples of which are illustrated in the accompanying drawings. In the following detailed description, numerous specific details are set forth in order to provide a sufficient understanding of the subject matter presented herein, but it will be apparent to one of ordinary skill in the art that the subject matter may be practiced without these specific details. Moreover, the particular embodiments described herein are provided by way of example and should not be used to limit the scope of the invention to these particular embodiments. In other instances, well-known structures and components have not been described in detail so as not to unnecessarily obscure aspects of the embodiments of the invention.

It should be noted that the embodiments and examples described herein may be combined, added to, adjusted, or otherwise put together in any of various combinations. The features discussed could be combined into various different embodiment examples with aspects drawn from any of the examples shown in the figures or discussed herein. There is no intention of describing separate and distinct embodiments, rather, for ease of discussion, to describe many various features in different examples, that could be compiled into different examples.

Figure 1A:
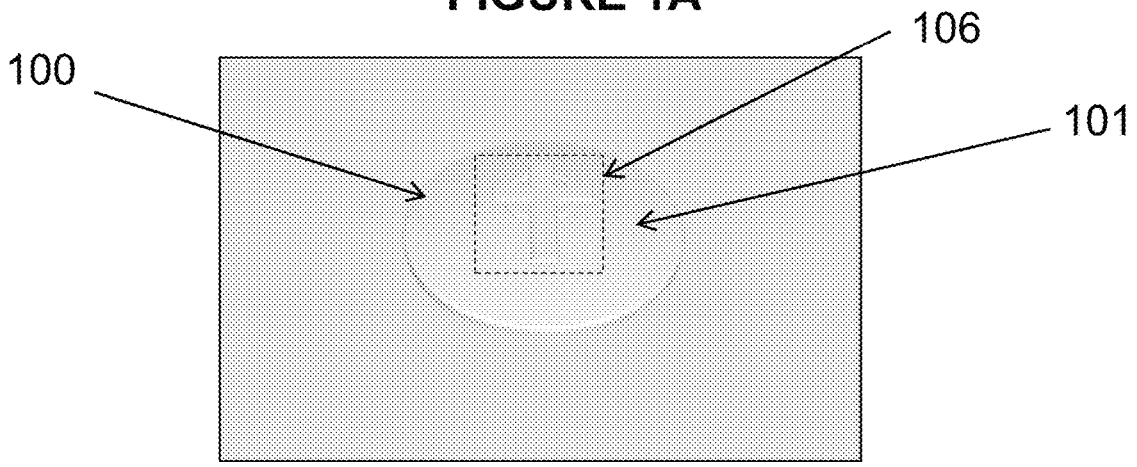
FIG. 1A illustrates a top diagonal view of a first embodiment of a monument cap.
Figure 1B:
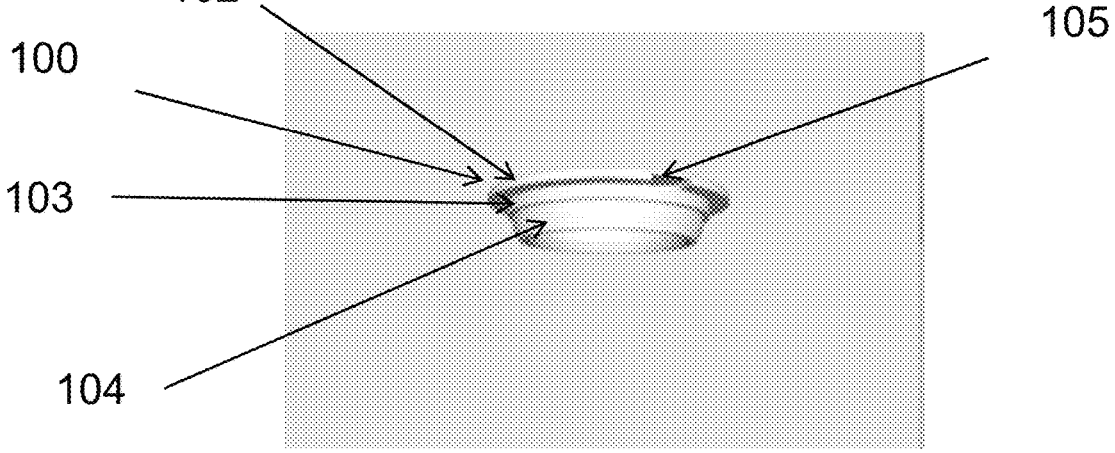
FIG. 1B illustrates a bottom diagonal view of the first embodiment of a monument cap.

A first embodiment is depicted in FIGS. 1A-B. FIG. 1A shows a top diagonal view of monument cap 100. Monument cap 100 comprises circular lid 101 bearing an optional ornamental design 106 on the top face.

Figure 5A:
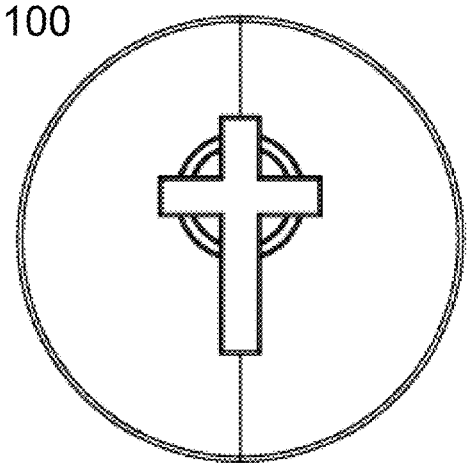
FIG. 5A illustrates a top view of the first embodiment of a monument cap.
Figure 5B:
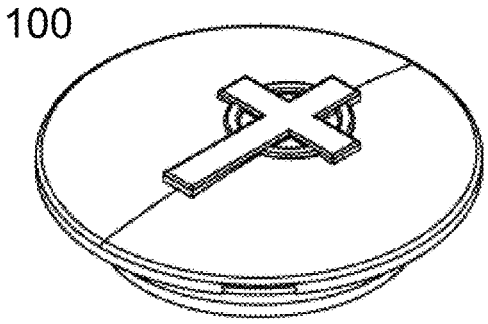
FIG. 5B illustrates a top diagonal view of the first embodiment of a monument cap.
Figure 5C:
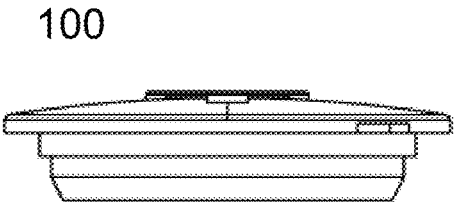
FIG. 5C illustrates a side view of the first embodiment of a monument cap.
Figure 5D:
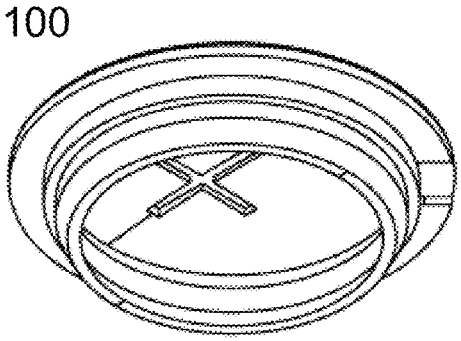
FIG. 5D illustrates a bottom diagonal view of the first embodiment of a monument cap.
Figure 6A:
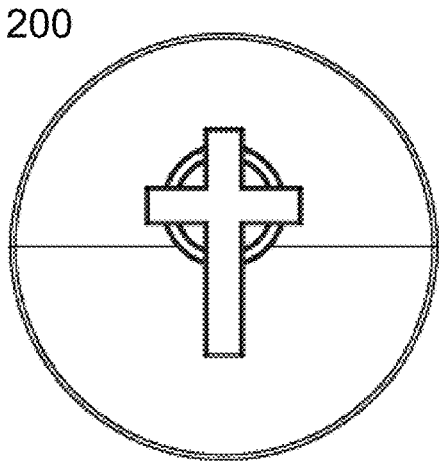
FIG. 6A illustrates a top view of the second embodiment of a monument cap.
Figure 6B:
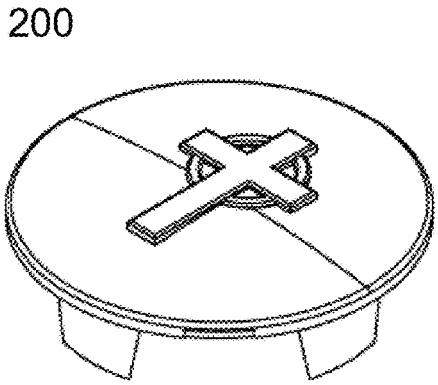
FIG. 6B illustrates a top diagonal view of the second embodiment of a monument cap.
Figure 6C:
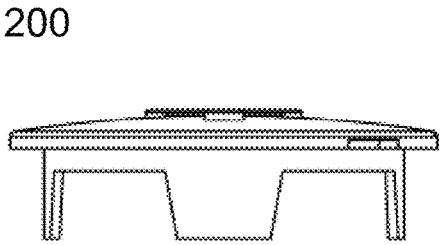
FIG. 6C illustrates a side view of the second embodiment of a monument cap.
Figure 6D:
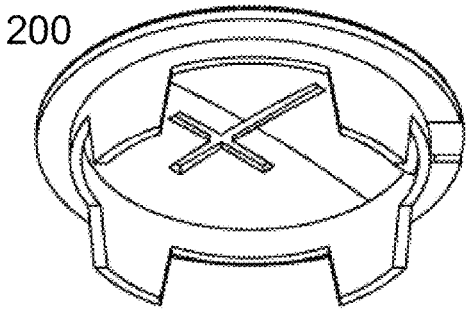
FIG. 6D illustrates a bottom diagonal view of the second embodiment of a monument cap.
Figure 7A:
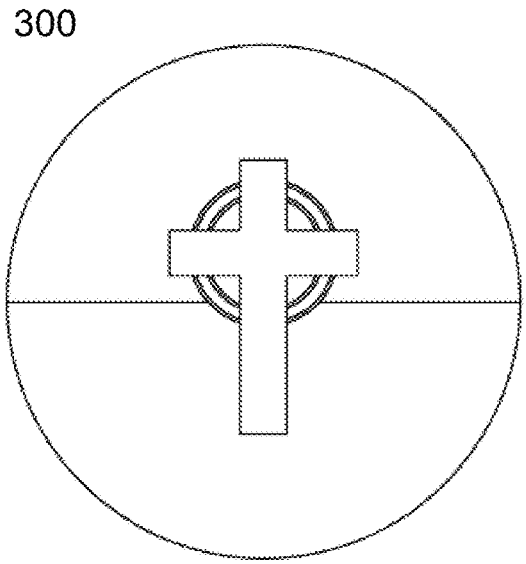
FIG. 7A illustrates a top view of the third embodiment of a monument cap.
Figure 7B:
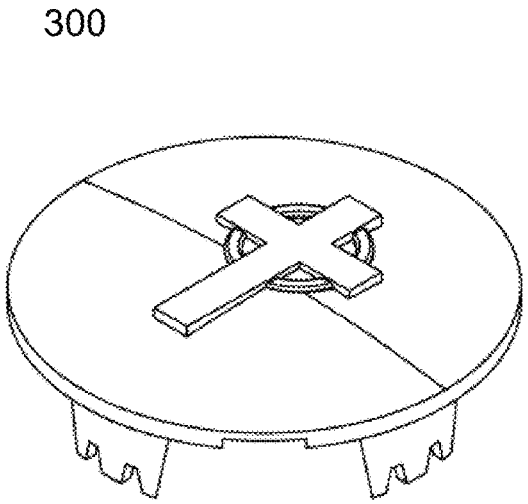
FIG. 7B illustrates a top diagonal view of the third embodiment of a monument cap.
Figure 7C:
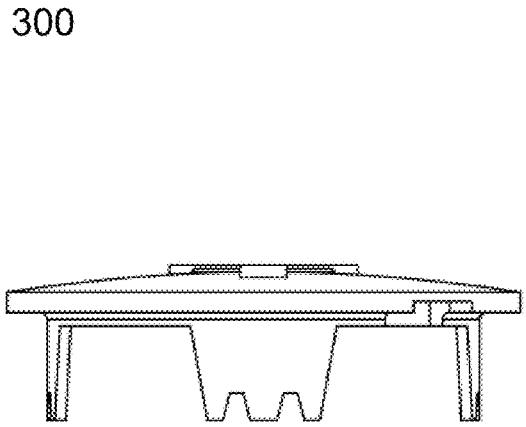
FIG. 7C illustrates a side view of the third embodiment of a monument cap.
Figure 7D:
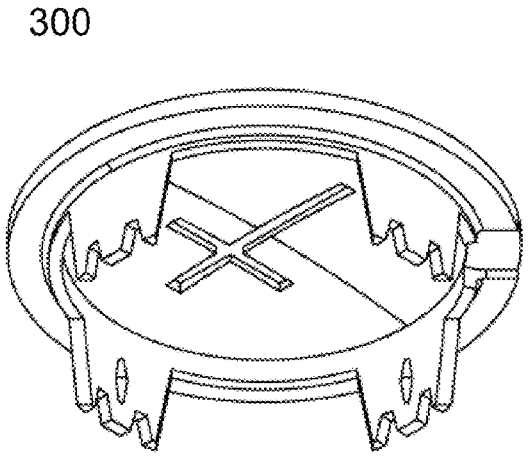
FIG. 7D illustrates a bottom diagonal view of the third embodiment of a monument cap.
Figure 7E:
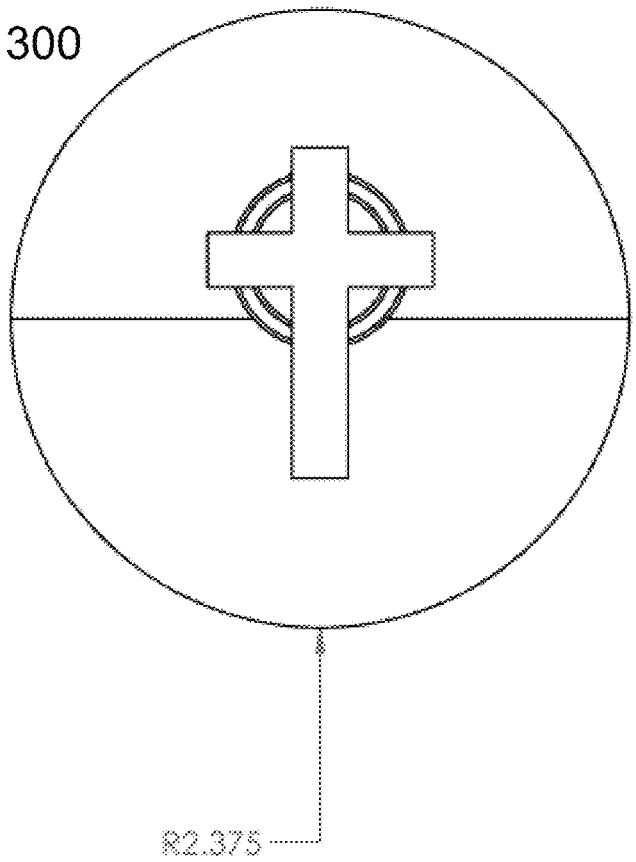
FIG. 7E illustrates another top view of the third embodiment of a monument cap, with dimension information.
Figure 7F:
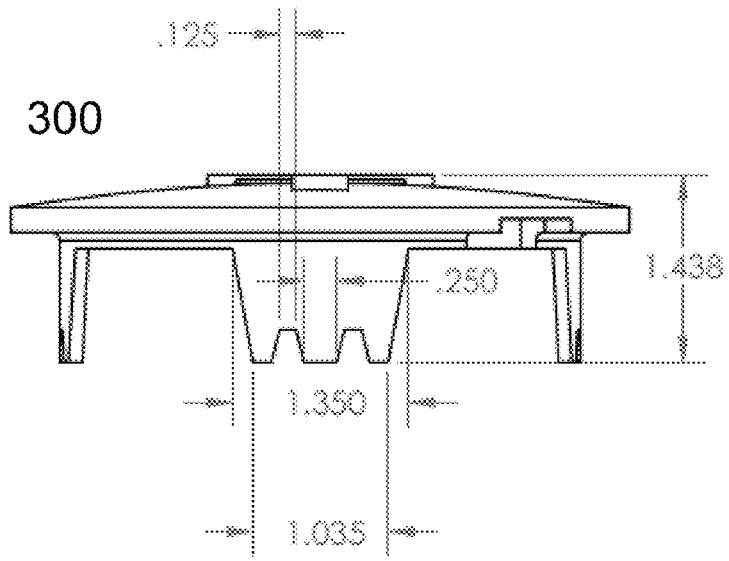
FIG. 7F illustrates another side view of the third embodiment of a monument cap, with dimension information.
Figure 8A:
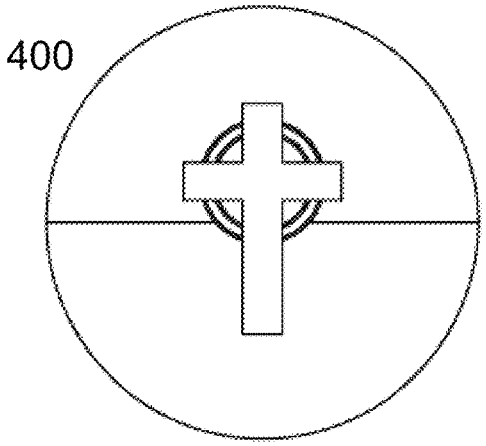
FIG. 8A illustrates a top view of the fourth embodiment of a monument cap.
Figure 8B:
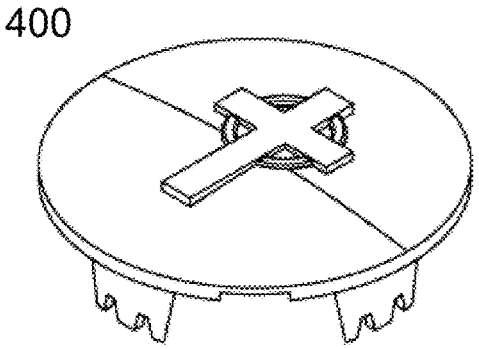
FIG. 8B illustrates a top diagonal view of the fourth embodiment of a monument cap.
Figure 8C:
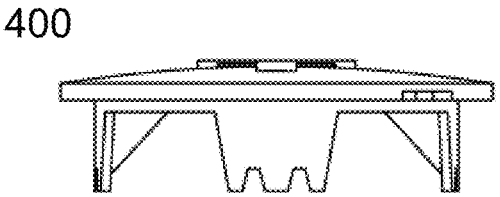
FIG. 8C illustrates a side view of the fourth embodiment of a monument cap.
Figure 8D:
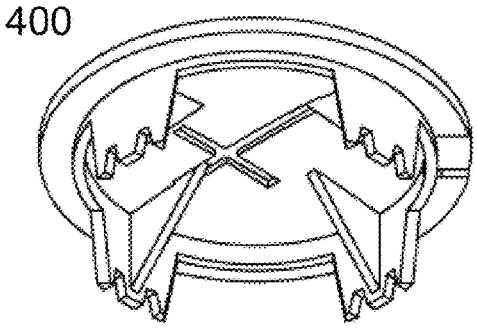
FIG. 8D illustrates a bottom diagonal view of the fourth embodiment of a monument cap.

FIG. 1B shows a side view of monument cap 100. Monument cap 100 comprises sidewall 102 along the outer edge of circular lid 101 with a groove 105. In the example, monument cap 100 includes a further inner sidewall 103 that protrudes from the bottom face of circular lid 101, with a smaller circumference than sidewall 102, and another inner sidewall 104 protruding below inner sidewall 103, with a smaller circumference than sidewall 103. Sidewall 104 in some examples, may protrude vertically and then taper slightly inward. This is shown also in FIG. 5A.

The thickness of sidewalls 103 and 104 may vary. In one embodiment, the thickness of sidewall 103 is 0.25 inches and the thickness of sidewall 104 is 0.5 inches, with the bottom 0.25 inches of sidewall 103 tapering inward. In such examples, sidewalls 102, 103, and 104 together form a plurality of separate surfaces of varying diameter ideal for forming a friction fit for securing monument cap 100 to the sides of a hole or receiving structure. Optionally, the foregoing structure can comprise a screw thread structure, a turn and lock arrangement, or any combination of these.

In the example shown in FIGS. 1A-1B, the tapered and/or varying diameter nature of sidewalls 102, 103, and 104 allow monument cap 100 to engage with the sides of holes or receiving structures of varying diameters.

The width of sidewalls 102, 103 and 104 may vary. In some examples, the width of sidewall 102 may be 4.750 inches, the width of sidewall 103 may be 4 inches, and the longest width of sidewall 103 may be 3.750 inches while the shortest width of sidewall 103 as it tapers inward may be 3.5 inches, or variations of these dimensions by 0.25, 0.5, 0.75, and/or 1 inch in any combination.

In addition, the height of sidewalls 102, 103, and 104 can vary in size. In one variation, the collective height of sidewalls 103, 104, and 105 is 2 inches. One of ordinary skill in the art will appreciate that other collective heights (e.g., 1 inch, 3 inches, or 4 inches or any other size) can be used instead.

Optionally, sidewalls 103 and 104 may have ridges along their circumferences to increase the friction with the sides of a hole or receiving structure, which further enhances the adherence between monument cap 100 and the hole or receiving structure.

Additionally, sidewalls 103 and 104 may have ridges along their inner faces to increase strength and durability when inserted into the receiving structure.

Figure 2A:
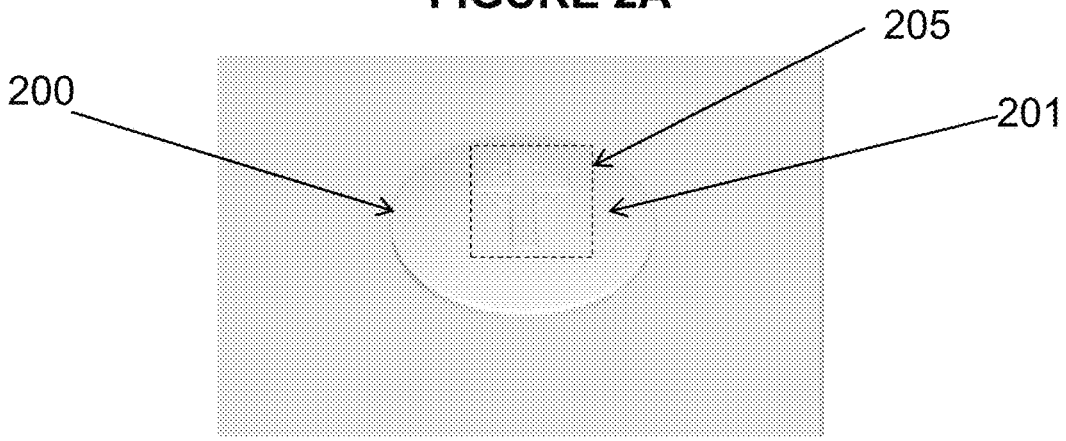
FIG. 2A illustrates a top diagonal view of a second embodiment of a monument cap.
Figure 2B:
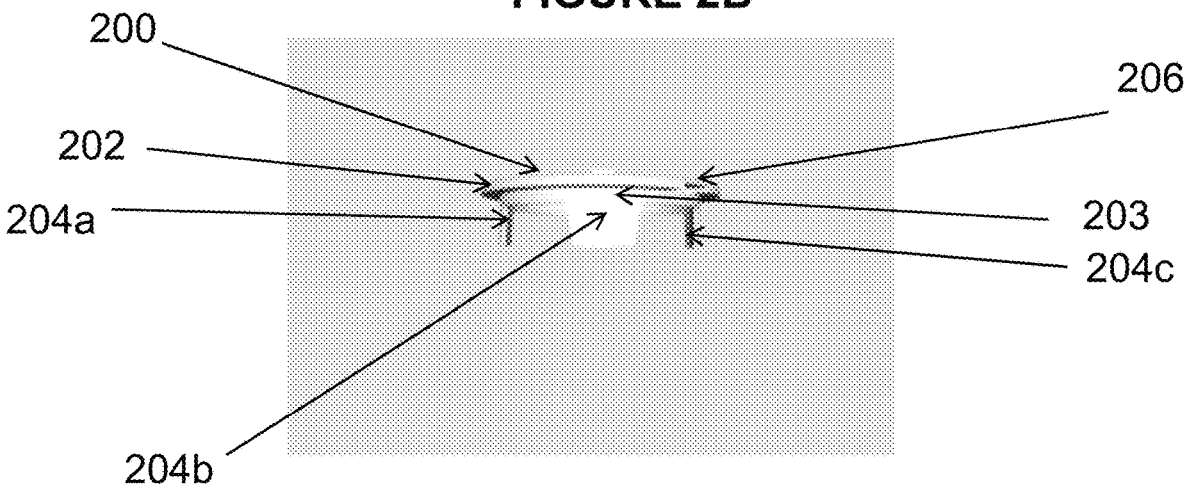
FIG. 2B illustrates a side view of the second embodiment of a monument cap.
Figure 2C:
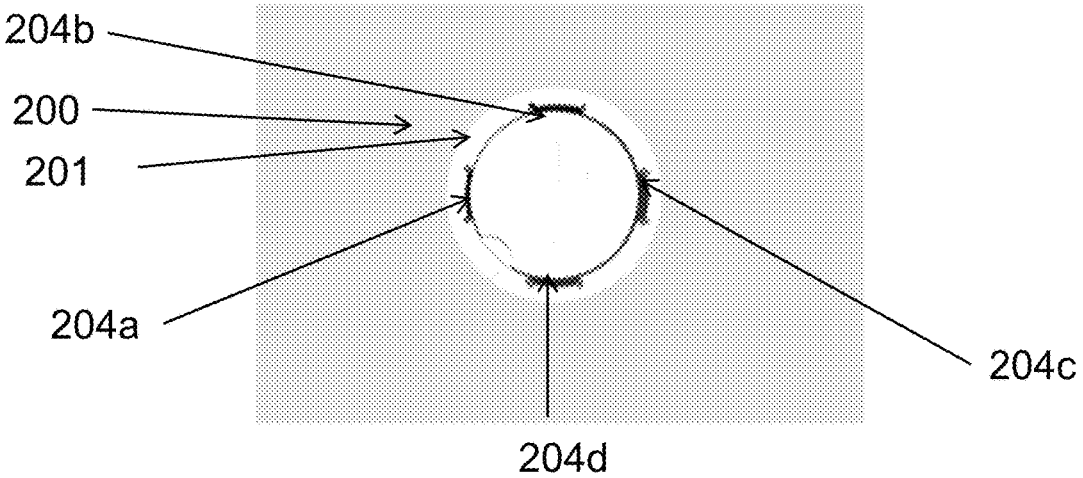
FIG. 2C illustrates a bottom view of the second embodiment of a monument cap.

A second embodiment is depicted in FIGS. 2A-C. FIG. 2A shows a top diagonal view of monument cap 200. Monument cap 200 comprises circular lid 201 bearing an optional ornamental design 205 on the top.

FIG. 2B shows an example side view of monument cap 200. Monument cap 200 comprises sidewall 202 along the outer edge of circular lid 201 with a groove 206. Optionally, monument cap 200 comprises further inner sidewall 203, which protrudes from the bottom face of circular lid 201 and has a smaller outer diameter than the sidewall 202. In such examples, sidewall 203 may include four legs 204*a-d* positioned equidistant from each other (204*d* is not visible in FIG. 2B as it is directly behind 204*b*). In one alternative, the number of legs is two. In another alternative, the number of legs 204 may be three. Any number of legs could be used, including but not limited to four, five, six, seven, and/or eight. The legs 204 need not be equally spaced as shown, although they may be.

FIG. 2C shows a bottom view of monument cap 200 showing legs 204*a-d* placed equidistant from each other. In such examples, legs 204*a-d* can secure monument cap 200 to the sides of a hole or receiving structure. Optionally, legs 204*a-d* may have ridges along their outer faces to increase the friction with the sides of a hole or receiving structure, which further enhances the adherence between monument cap 200 and the hole or receiving structure. Additionally, legs 204*a-d* may have ridges along their inner faces to increase strength and durability when inserted into the receiving structure. The advantage of legs 204*a-d* is that they resiliently deflect for easier insertion into the hole or receiving structure, and for exerting force to maintain the friction fit.

Figure 3A:
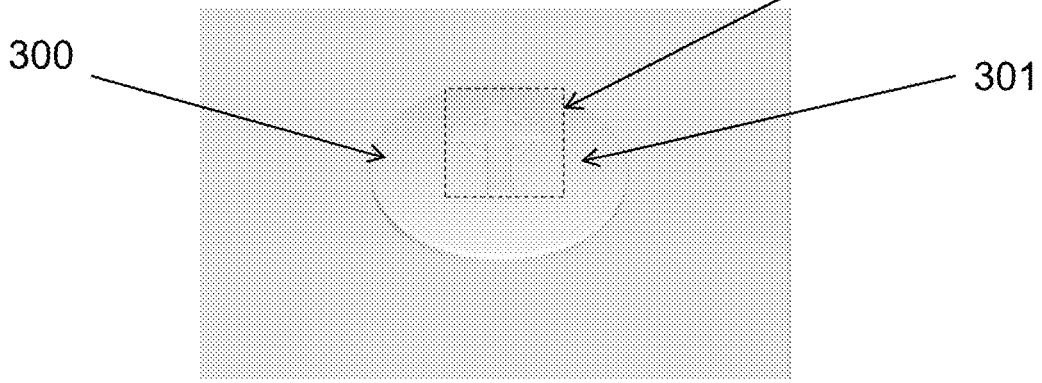
FIG. 3A illustrates a top diagonal view of a third embodiment of a monument cap.
Figure 3B:
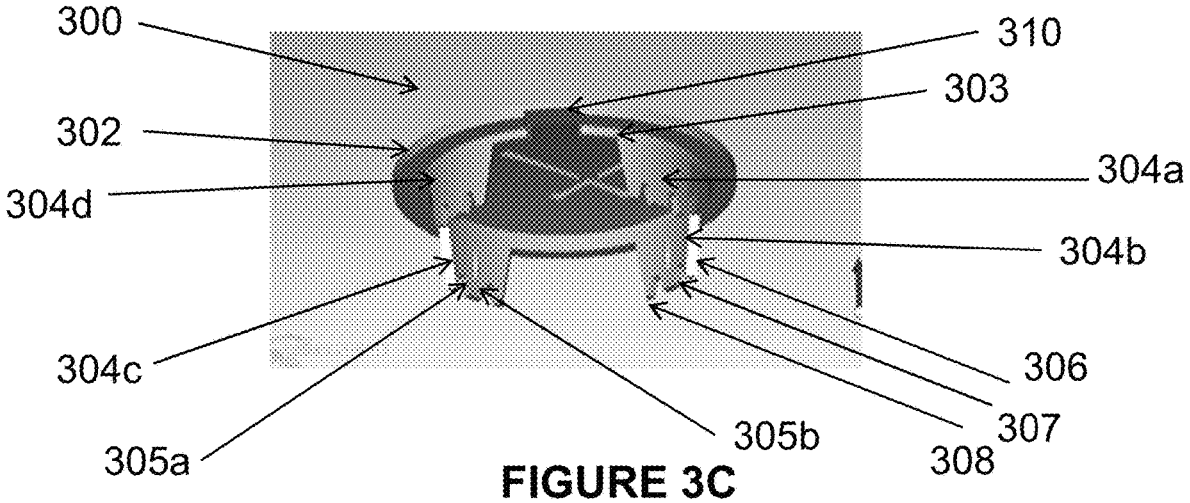
FIG. 3B illustrates a bottom diagonal view of the third embodiment of a monument cap.
Figure 3C:
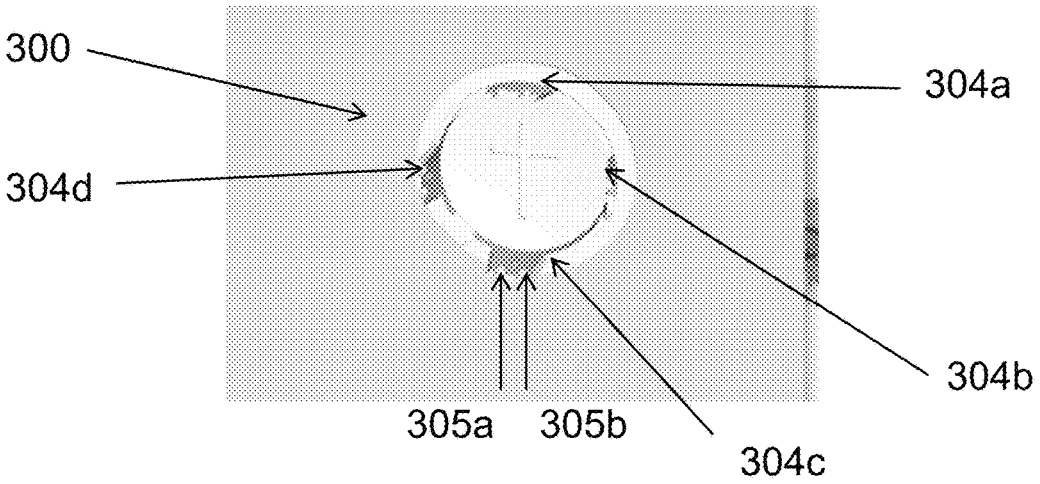
FIG. 3C illustrates another bottom diagonal view of the third embodiment of a monument cap.

A third embodiment is depicted in FIGS. 3A-C. FIG. 3A shows a top diagonal view of monument cap 300 with a circular lid 301 bearing an optional ornamental design 309 on the top. FIG. 3B shows a bottom diagonal view of monument cap 300. Monument cap 300 comprises sidewall 302 along its outer edge and a groove 310 and a further inner sidewall 303, with a smaller outer diameter than the sidewall 302, with four legs 304*a-d*, longer in length than the four legs 204*a-d* depicted in FIG. 2B, positioned equidistant from each other. In the example, each of the legs 304*a-d* has two grooves 305*a-b* that result in three downward-facing teeth 306, 307, 308. These downward facing teeth may aid in the ease of inserting this structure when the hole of the receiving structure is impacted with leaves, weeds, and other debris. FIG. 3C shows a bottom diagonal view of monument cap 300. In such examples, legs 304*a-d* can secure monument cap 300 to the sides of a hole or receiving structure. Optionally, legs 304*a-d* may have ridges along their outer faces to increase the friction with the sides of a hole or receiving structure, which further enhances the adherence between monument cap 300 and the hole or receiving structure. Additionally, legs 304*a-d* may have ridges along their inner faces to increase strength and durability when inserted into the receiving structure.

Figure 4A:
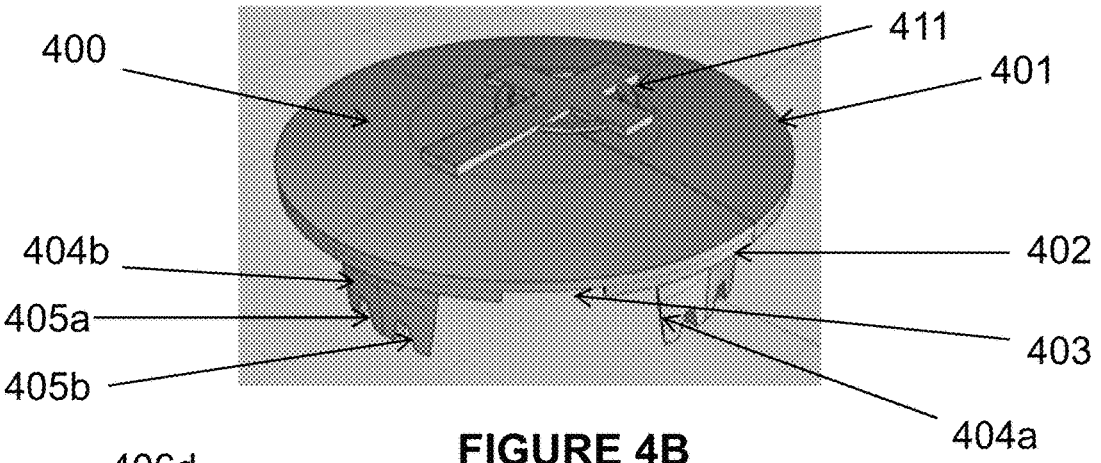
FIG. 4A illustrates a top diagonal view of a fourth embodiment of a monument cap.
Figure 4B:
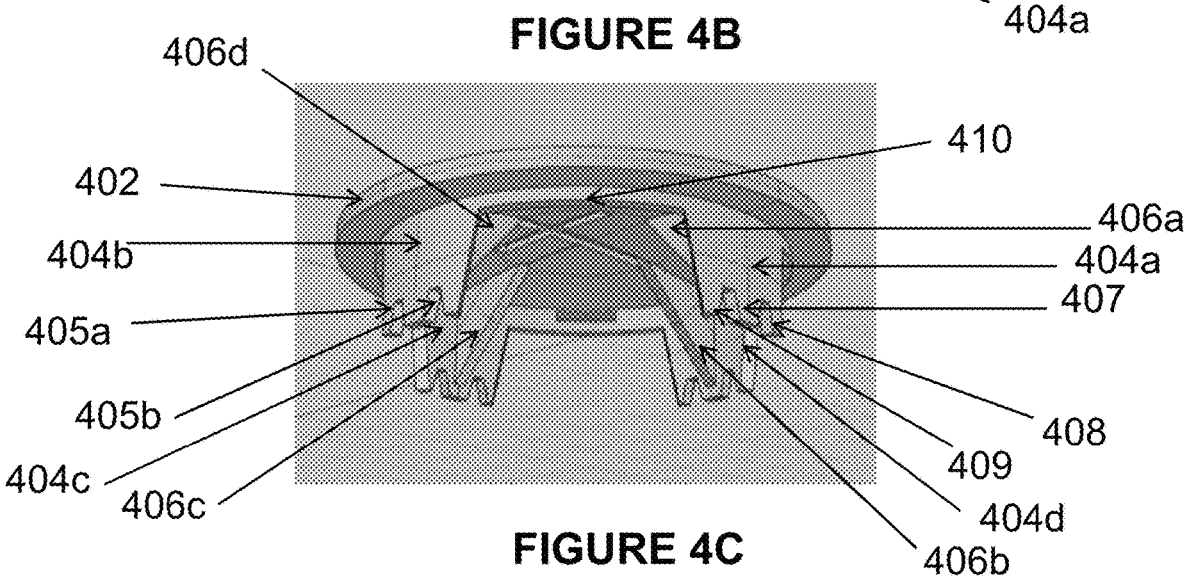
FIG. 4B illustrates a bottom diagonal view of the fourth embodiment of a monument cap.
Figure 4C:
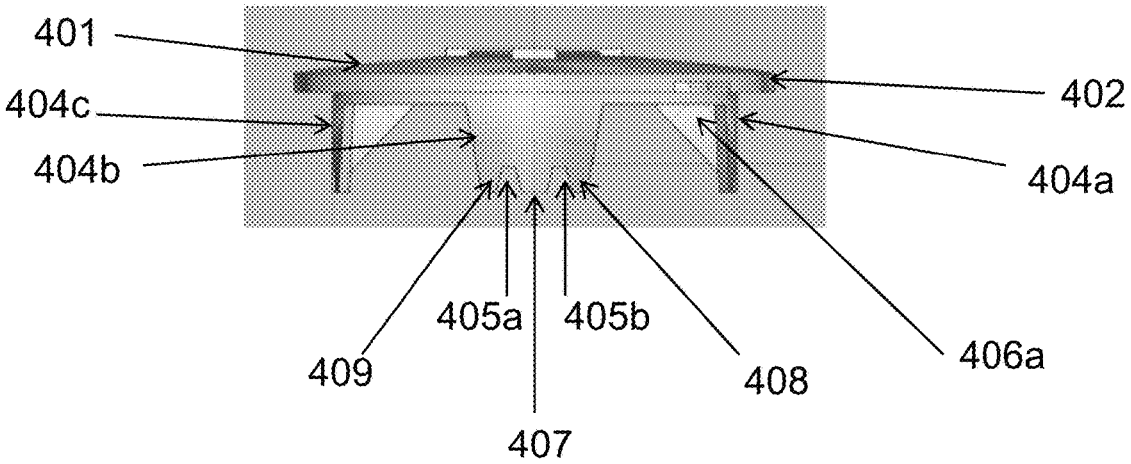
FIG. 4C illustrates a side view of the fourth embodiment of a monument cap.

A fourth embodiment is depicted in FIGS. 4A-C. FIG. 4A shows a top diagonal view of monument cap 400 including a circular lid 401 bearing an optional ornamental design 411 on the top with a sidewall 402 along its outer edge. A portion of the sidewall 402 has a groove 403 in this example.

FIG. 4B shows a bottom diagonal view of monument cap 400 with a further inner sidewall 410 that protrudes from the bottom face of circular lid 401, with a smaller outer diameter than the sidewall 402, with four legs 404*a-d* positioned equidistant from each other. The legs 404*a-d* are stabilized with braces 406*a-d* in the example.

FIG. 4C shows a side view of monument cap 400 where each of the legs 404*a-d* has two grooves 405*a-b* that result in three downward-facing teeth 407, 408, 409. In other alternatives, the number of downward-facing teeth could be different, for example, two, four, five, or any other number. In the example, legs 404*a-d* can secure monument cap 400 to the sides of a hole or receiving structure. (Leg 404*d* is not visible in FIG. 4C as it is diametrically opposite of Leg 404*b*.) Optionally, legs 404*a-d* may have ridges along their outer faces to increase the friction with the sides of a hole or receiving structure, which further enhances the adherence between monument cap 400 and the hole or receiving structure. Additionally, legs 404*a-d* may have ridges along their inner faces to increase strength and durability when inserted into the receiving structure.

In the embodiments of FIGS. 1-4, the width of the circular lid (101, 201, 301, 401) may vary. In some examples, the width of the circular lid may be 4.75 inches. In some examples, alone or in combination, the thickness of the ornamental design (106, 205, 309, 411) may vary. In some examples, the thickness of the ornamental design may be 0.0625 inches. In some examples, alone or in combination, the thickness of the sidewall (102, 202, 302, 402) may vary. In some examples, the thickness of the sidewall may be 0.1875 inches. In some examples, the vertical distance from the bottom of the ornamental design to the top edge of sidewall may be 0.1875 inches or variations of these dimensions discussed here, by 0.25, 0.5, 0.75, and/or 1 inch in any combination.

In the embodiments of FIGS. 2-4, the number and the length or width of the legs may vary. For example, the vertical length of the legs can be any number (e.g., 1-4 inches) to maximize the stability or sturdiness of the monument cap. In addition, the width of the legs (towards the top of the leg closest to the sidewall to the bottom of the leg) may be any number (e.g., 1-2 inches). In some embodiments, additionally or alternatively, the width of the legs closest to the sidewall may be 1.35 inches and the width of the leg towards the bottom may be 1.035 inches. In some embodiments, additionally or alternatively, the entire length of the device from the top of the circular lid to the bottom of the leg may be 1.438 inches, the sidewall from which the legs protrude may be 0.125 inches, and the length of the legs may be 0.875 inches. In some embodiments, additionally or alternatively, each of the legs may be, but are not required to be, supported by a brace to enhance rigidity. In such examples, the legs may be made of a flexible material (such as plastic) such that they flare or extend outward in their natural state or when the monument cap is not inserted into the opening. Such legs may have a tendency to resiliently press outward against the sides of the opening for added stability and sturdiness and will have the ability to engage with holes of receiving structures of varying diameters. One of the many benefits of this monument cap is that it is not easily dislodged by a lawn mower or a passerby and these parameters may be combined to increase its stability and sturdiness.

FIGS. 5A, 5B, 5C, and 5D show additional details, some optional and some in the alternative to details already discussed, of monument cap 100.

FIGS. 6A, 6B, 6C, and 6D show additional details, some optional and some in the alternative to details already discussed, of monument cap 200.

FIGS. 7A, 7B, 7C, 7D, 7E, and 7F show additional details, some optional and some in the alternative to details already discussed, of monument cap 300, including exemplary dimensions of certain features.

FIGS. 8A, 8B, 8C, and 8D show additional details, some optional and some in the alternative to details already discussed, of monument cap 400.

Figure 9:
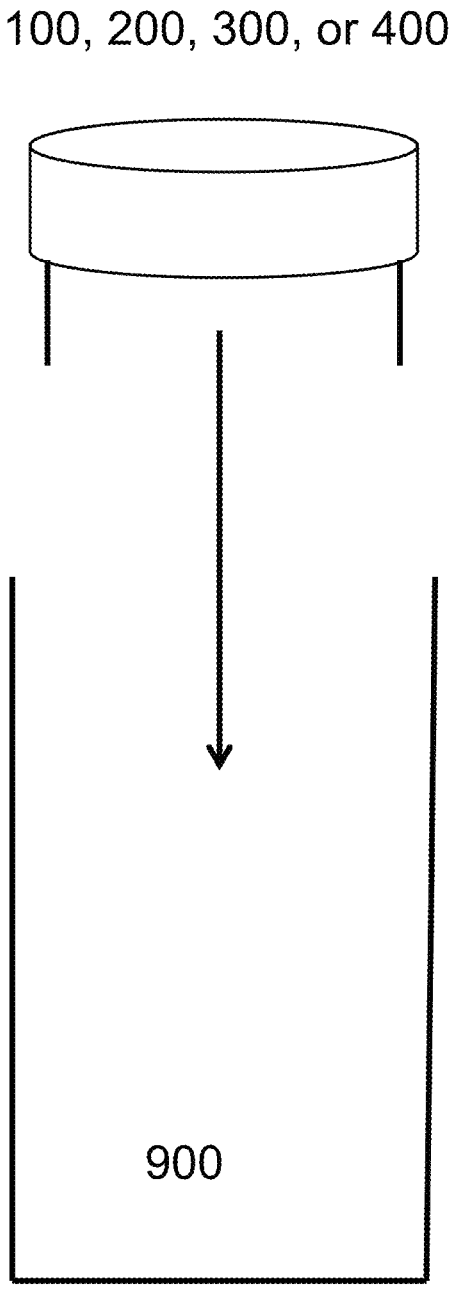
FIG. 9 shows the monument cap of any of FIGS. 1-8 being placed into an opening.

FIG. 9 shows monument cap 100, 200, 300, or 400 being placed into opening 900. Opening 900 can be a hole in the ground or can be formed by a receiving structure made of concrete, metal, or another material, where the receiving structure previously was placed into the ground. In some instances, opening 900 itself can be a flower vase, such that monument cap 100, 200, 300, or 400 can be placed over opening 900 in a flower vase when a flower vase is present or can be placed over an opening (which will be another instantiation of opening 900) in the ground or a receiving structure in the ground when a flower vase is not present. One of ordinary skill in the art will appreciate that in such instances, the dimensions of monument cap 100, 200, 300, or 400 will need to be appropriately sized to fit each possible opening 900 that might be present in the graveyard or cemetery (e.g., a hole in the ground or an opening within a vase that may be placed into the hole in the ground).

Another additional benefit of the monument cap embodiments is that the monument cap may shelter the opening from weeds, debris, leaves and in some instances water from accumulating in the opening. For added effectiveness of preventing a collection of water, in some example embodiments, additionally or alternatively, the circular lid may slope downward from the center of the circular lid, forming a tent-like structure so that water will flow outward.

To prevent theft of the monument cap itself, additional security-related features used in other known devices may be added to the monument cap. For example, the circular lid may have a slot either on its surface or on the side, depending upon the width of the lip, for a key to be inserted that will interact with the circular lid to dislodge it from the hole or receiving structure. In this regard, a circular lid of a thickness of 0.5 inches may be sufficient to allow for such a slot.

As another example, the circular lid may have an identifier (e.g., a QR code, bar code label, or any combination of these or other labels) that is configured to be able to be scanned with a scanner on a smartphone or other image capture device or scanner for identification purposes without the need for dislodging the monument cap from the hole or receiving structure. This identifier (such as a QR code or bar code) optionally may be used in the location shown previously for ornamental design 102, 205, 309, or 410.

The material of the monument cap may vary depending on the characteristics desired. The monument cap can be made of plastic, plastic weighted with metal, rubber, metal, or other known materials alone or in combination. Plastic and rubber typically are relatively cheap and easy to manufacture. Plastic typically is a relatively light material. Metal typically is more expensive and heavier and would provide added weight and anchor for the monument cap.

While the foregoing has been with reference to a particular embodiment of the disclosure, it will be appreciated by those skilled in the art that changes in this embodiment may be made without departing from the principles and spirit of the disclosure, the scope of which is defined by the appended claims.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Although certain presently preferred implementations of the invention have been specifically described herein, it will be apparent to those skilled in the art to which the invention pertains that variations and modifications of the various implementations shown and described herein may be made without departing from the spirit and scope of the invention. Accordingly, it is intended that the invention be limited only to the extent required by the applicable rules of law.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

The invention claimed is:

1. A monument cap comprising:

a circular lid with a first sidewall along its circumference;

a second sidewall protruding from a bottom face of the circular lid, the second sidewall having an outer diameter that is smaller than an outer diameter of the first sidewall;

a plurality of legs extending downward from the second sidewall for engaging with an opening, wherein each leg of the plurality of legs includes two spaced grooves at a bottom edge thereof which define three downward-facing teeth; and a plurality of brace members each extending to and between one of the plurality of legs and the bottom face.

2. The monument cap of claim 1, wherein the monument cap is constructed of plastic.

3. The monument cap of claim 1, wherein the monument cap is constructed of metal.

4. The monument cap of claim 1, wherein the monument cap is constructed of a combination of plastic and metal.

5. The monument cap of claim 1, wherein the monument cap is constructed of rubber.

* * * * *